US008216032B2

(12) United States Patent
Komoto

(10) Patent No.: US 8,216,032 B2
(45) Date of Patent: Jul. 10, 2012

(54) COIN DISPENSING DEVICE AND COIN PROCESSING MACHINE

(75) Inventor: Kazuhiro Komoto, Himeji (JP)

(73) Assignee: Glory Ltd., Hyogo (JP)

( * ) Notice: Subject to any disclaimer, the term of this patent is extended or adjusted under 35 U.S.C. 154(b) by 350 days.

(21) Appl. No.: 12/529,064

(22) PCT Filed: Mar. 29, 2007

(86) PCT No.: PCT/JP2007/056812

§ 371 (c)(1),
(2), (4) Date: Aug. 28, 2009

(87) PCT Pub. No.: WO2008/120344

PCT Pub. Date: Oct. 9, 2008

(65) Prior Publication Data

US 2010/0029188 A1 Feb. 4, 2010

(51) Int. Cl.
*G07D 1/00* (2006.01)

(52) U.S. Cl. ..... 453/29

(58) Field of Classification Search ..... 453/1, 2, 453/29, 30, 33, 34, 35, 49, 56, 57
See application file for complete search history.

(56) References Cited

U.S. PATENT DOCUMENTS

| | | | | |
|---|---|---|---|---|
| 3,680,566 | A * | 8/1972 | Tanaka et al. | 453/4 |
| 4,558,711 | A * | 12/1985 | Yoshiaki et al. | 453/3 |
| 6,168,001 | B1 | 1/2001 | Davis | |

FOREIGN PATENT DOCUMENTS

| | | | |
|---|---|---|---|
| DE | 197 01 943 Al | | 10/1997 |
| GB | 2 242 051 | A | 9/1991 |
| GB | 2 386 734 | A | 9/2003 |
| JP | 8180231 | A | 7/1996 |
| JP | 8212408 | A | 8/1996 |
| JP | 11316864 | A | 11/1999 |
| JP | 2002 260067 | | 9/2002 |
| JP | 2003281588 | A | 10/2003 |
| JP | 2004280716 | A | 10/2004 |
| JP | 2004295694 | A | 10/2004 |
| JP | 2004334597 | A | 11/2004 |
| JP | 2006195528 | A | 7/2006 |
| JP | 3865310 | B2 | 1/2007 |

OTHER PUBLICATIONS

European Supplementary Search Report (dated Jul. 26, 2010—6 pages).
European Examination Report (dated Apr. 29, 2011—5 pages).

* cited by examiner

*Primary Examiner* — Mark Beauchaine
(74) *Attorney, Agent, or Firm* — Renner, Kenner, Greive, Bobak, Taylor & Weber

(57) ABSTRACT

A coin dispensing device having a mechanism to reliably dispensing a predetermined number of coins. Coins are accommodated on a surface side of a rotary disc rotating at a position tilted at a predetermined angle. A dispensing and transporting passage guides coins dispensed by rotation of the rotary disc to a coin inlet/outlet. A gate member for opening/closing the coin inlet/outlet is provided at the coin inlet/outlet. A projection is provided at the dispensing and transporting passage. When coins are dispensed, the projection retracts under the dispensing and transporting passage according to opening operation of the gate member, allowing the coins to be transported. When no coin is dispensed, the projection projects from the dispensing and transporting passage according with closing operation of the gate member to regulate transportation of coins.

3 Claims, 4 Drawing Sheets

COIN DISPENSING DEVICE AND COIN PROCESSING MACHINE

CROSS REFERENCE TO RELATED APPLICATIONS

This is a U.S. national phase application under 35 U.S.C. §371 of International Patent Application No. PCT/JP2007/056812 filed Mar. 29, 2007. The International Application was published on Oct. 9, 2008 as International Publication No WO/2008/120344 under PCT Article 21(2); the contents of these applications are incorporated herein in their entireties.

TECHNICAL FIELD

The present invention relates to a coin dispensing device for dispensing coins and a coin processing machine using the coin dispensing devices.

BACKGROUND ART

A coin dispensing device mounted on a circulation type coin depositing and dispensing machine has been conventionally known as a coin dispensing device for dispensing coins. The coin dispensing device serves as a coin accommodating unit, has a denomination-specific cylindrical accommodating portion and enables accommodating and dispensing of coins from an opening provided in an upper part of the cylindrical accommodating portion (For example, see Japanese Laid-open Patent Publication No. 2004-334597 (p. 9, FIGS. 1 and 2) ("JP '597")).

Additionally, as a coin dispensing device having another structure, a coin dispensing device mounted on a coin depositing and dispensing unit is known. In the coin dispensing device, coins are pooled, with the coins not aligned, on a transporting belt tilted upward to a dispensing port for dispensing coins, and a regulating portion for aligning the coins, which are pooled with the coins not aligned, in one layer and one line is provided on this side of the dispensing port. The transporting belt rises to the downstream side in a dispensing and transporting direction, and is curved at two or more positions in the dispensing and transporting direction or formed in a curved-surface shape so that a coin jam is prevented on the transporting belt (For example, see Japanese Patent Publication No. 3865310 (pp. 3, 4 and 6, FIGS. 3 and 6) ("JP '310")).

However, in the coin dispensing device disclosed in JP '597, although coins can be accommodated and dispensed from an opening provided in an upper part of a cylindrical accommodating portion, coins are required to be piled up and accommodated in the cylindrical accommodating portion with the coins aligned and there is a possibility that coins are not correctly piled up and stood up in accommodation. If coins are accommodated with the coins stood up, a dispensing error occurs at the time of dispensing.

Additionally, in the coin dispensing device disclosed in JP '310, a transporting belt rises to the downstream side in a dispensing and transporting direction, and is curved at two or more positions in the transporting direction or formed in a curved-surface shape so that a coin jam is prevented on the transporting belt. However, when coins pile up in the vicinity of a dispensing port with the transporting belt rotating, unbalance is caused by slight vibration, deformation of a coin, or the like, and a dispensing error occurs due to the piling-up and jamming of the coins, because succeeding coins come into press-contact with the preceding coins and pile up and no regulating member for preventing coins from piling on each other is provided above the transporting belt.

The present invention has been made in view of the above problems, and aims to provide a coin dispensing device and a coin processing machine using the coin dispensing device, the coin dispensing device being capable of preventing coins from jamming an accommodating portion and dispensing coins one by one, having a simple mechanism enabling a predetermined number of coins to be reliably dispensed, and being capable of promptly additionally dispensing coins.

SUMMARY OF THE INVENTION

A coin dispensing device according to the present invention includes: an accommodating portion for accommodating coins with the coins not aligned; a dispensing port for dispensing coins in the accommodating portion from the accommodating portion; a dispensing unit for dispensing coins one by one from the accommodating portion; a dispensing and transporting passage having a dispensing and transporting face for guiding coins, which are dispensed one by one from the accommodating portion by the dispensing unit, to the dispensing port; a detecting unit which is disposed downstream, in relation to the dispensing port, in a transporting direction and detects coins dispensed from the dispensing port; an opening/closing member for opening/closing the dispensing port; and a projection which can project from/retract under the dispensing and transporting face of the dispensing and transporting passage, and in dispensing coins, retracts under the dispensing and transporting face in accordance with opening operation of the opening/closing member to the dispensing port and allows coins to be transported to the dispensing and transporting passage, or in dispensing no coin, projects from the dispensing and transporting face in accordance with closing operation of the opening/closing member to the dispensing port, regulates transportation of coins to the dispensing and transporting passage and returns the coins to the accommodating portion.

A coin dispensing device according to the present invention includes: a controlling unit which makes the opening/closing member close the dispensing port and the projection project from the dispensing and transporting passage when the detecting unit detects a predetermined number of coins are dispensed.

With a coin dispensing device according to the present invention the dispensing unit includes: a rotary disc for rotating at a position tilted at a predetermined angle in relation to a horizontal direction; a hopper which faces and covers a surface side of the rotary disc, has a one side face which is a surface of the rotary disc, pools coins with the coins not aligned, and is opened upward; and a plurality of picking-up members which project vertically from the surface of the rotary disc, and in dispensing coins, by rotation of the rotary disc, locks coins to be dispensed and sends the coins to the dispensing and transporting passage.

A coin processing machine according to the present invention includes: coin dispensing devices each for dispensing coins one by one: a transporting unit for transporting coins, which are dispensed from the coin dispensing devices, one by one; a recognition unit for recognizing at least a denomination of a coin transported by the transporting unit; and a coin dispensing port for dispensing coins, which are transported by the transporting unit, to the outside of a machine body, the coin dispensing device including: an accommodating portion for accommodating coins with the coins not aligned; a dispensing port for dispensing coins in the accommodating portion to the transporting unit; a dispensing unit for dispensing coins one by one from the accommodating portion; a dispensing and transporting passage having a dispensing and transporting face for guiding coins, which are dispensed one by one from the accommodating portion by the dispensing unit, to the dispensing port; a detecting unit which is disposed downstream, in relation to the dispensing port, in a transporting direction and detects coins dispensed from the dispensing port; an opening/closing member for opening/closing the dispensing port; and a projection which can vertically project from/retract under the dispensing and transporting face of the dispensing and transporting passage, and in dispensing coins, retracts under the dispensing and transporting face in accordance with opening operation of the opening/closing member to the dispensing port and allows coins to be transported to the dispensing and transporting passage, or in dispensing no coin, projects from the dispensing and transporting face in accordance with closing operation of the opening/closing member to the dispensing port, regulates transportation of coins to the dispensing and transporting passage and returns the coins to the accommodating portion.

With a coin processing machine according to the present invention, the dispensing unit includes: a rotary disc for rotating at a position tilted at a predetermined angle in relation to a horizontal direction; a hopper which faces and covers a surface side of the rotary disc, has a one side face which is a surface of the rotary disc, pools coins with the coins not aligned, and is opened upward; and a plurality of picking-up members which project vertically from the surface of the rotary disc, and in dispensing coins, by rotation of the rotary disc, locks coins to be dispensed and sends the coins to the dispensing and transporting passage, and a controlling unit is provided by which, when dispensing of a predetermined number of coins is detected by a detecting unit, the rotary disc is continuously rotated, the dispensing port is closed by the opening/closing member, and the projection is projected from the dispensing and transporting face to regulate dispensing of coins, and when a coin not recognized as a normal coin by the recognition unit exists, the projection is retracted under the dispensing and transporting face in accordance with opening operation of the opening/closing member to a dispensing port, coins are allowed to be transported to the dispensing and transporting passage, and the rotary disc is continuously rotated until completion of dispensing of a predetermined number of normal coins.

A coin processing machine according to the present invention includes: a coin receiving port for receiving coins from the outside of the machine body; a feeding unit for receiving coins put in the coin receiving port and feeding coins one by one to the transporting unit; and sorting members each for sorting a coin to the corresponding coin dispensing device through the dispensing port, the coin being fed by the feeding unit, transported by the transporting unit and recognized as a normal coin by the recognition unit, wherein the projection is interlocked with the opening/closing member and sorting member.

With a coin processing machine according to the present invention, coins put in the coin receiving port are received in the feeding unit, fed one by one and transported by the transporting unit and recognized by the recognition unit, a coin recognized as a normal coin is transported to the corresponding coin dispensing device through the dispensing port, and a coin other than a normal coin is transported to a coin dispensing port.

A coin processing machine according to the present invention includes: a coin receiving port for receiving coins from the outside of the machine body; a feeding unit for receiving coins put in the coin receiving port and feeding coins one by one; an escrow unit which can store normal coins received from the coin receiving port, sends stored coins to the feeding unit when an accommodating instruction or returning instruction is received from the outside of the machine body; sorting members each of which is interlocked with the opening/closing member and projection and sorts a coin to the corresponding coin dispensing device through the dispensing port, the coin being fed by the feeding unit and recognized as a normal coin by the recognition unit; and a coin cassette which is removable from the machine body, and can collect coins in the machine body when being attached to the machine body.

A coin processing machine according to the present invention includes: a depositing controlling portion by which, when a depositing instruction is received from the outside of the machine body, coins received in the feeding unit are fed one by one, transported by the transporting unit and recognized by the recognition unit, normal coins are transported to the escrow unit, and coins other than normal coins are transported to the coin dispensing port; an accommodation controlling portion by which, when an accommodating instruction is received from the outside of the machine body after the depositing instruction, coins in the escrow unit are sent to the feeding unit, fed one by one, transported by the transporting unit and recognized by the recognition unit, a coin recognized as a normal coin is transported to the coin cassette in the case where the corresponding coin dispensing device is in a full state, or accommodated in the corresponding coin dispensing device through the dispensing port in the case of being not in the full state, and a coin not recognized as a normal coin by the recognition unit is transported to the coin cassette; and a return controlling portion by which, when a returning instruction is received from the outside of the machine body after the depositing instruction, coins in the escrow unit are sent to the feeding unit, fed one by one and transported by the transporting unit, and all coins are transported to the coin dispensing port.

According to a coin dispensing device of the present invention, coins, which are accommodated with the coins not aligned, can be reliably dispensed one by one without jamming an accommodating portion, a simple mechanism enables a predetermined number of coins to be reliably dispensed, and coins can be promptly additionally dispensed by retracting a projection under a dispensing and transporting face, because in the case of dispensing coins from the accommodating portion, the projection retracts under the dispensing and transporting face in accordance with opening operation of an opening/closing member to a dispensing port and coins are allowed to be transported to a dispensing and transporting passage, and in the case of dispensing no coin from the accommodating portion, the projection projects from the dispensing and transporting face in accordance with closing operation of the opening/closing member to the dispensing port, regulates transportation of coins to the dispensing and transporting passage and returns the coins to the accommodating portion.

According to a coin dispensing device of the present invention, in addition to the effect of the coin dispensing device above, when dispensing of a predetermined number of coins is detected by a detecting unit, the dispensing port is closed by the opening/closing member, the projection is projected from the dispensing and transporting passage, and thus the predetermined number of coins can be reliably dispensed.

According to a coin dispensing device of the present invention, in addition to the effect of the coin dispensing device above, coins can be accommodated with the coins not aligned and reliably dispensed one by one, because a dispensing unit includes: a rotary disc which is rotated at a position tilted at a predetermined angle in relation to a horizontal direction; and a hopper for pooling coins between the hopper and a surface side of the rotary disc with the coins not aligned, and a plurality of picking-up members projecting from the surface of the rotary disc lock and sending coins to the dispensing and transporting passage by rotation of the rotary disc.

According to a coin processing machine of the present invention, coins, which are accommodated with the coins not aligned, can be reliably dispensed one by one without jamming an accommodating portion, a simple mechanism enables a predetermined number of coins to be reliably dispensed, and coins can be promptly additionally dispensed by retracting a projection under a dispensing and transporting face, because in the case of dispensing coins from the accommodating portion of a coin dispensing device, the projection retracts under the dispensing and transporting face in accordance with opening operation of an opening/closing member to a dispensing port and coins are allowed to be transported to a dispensing and transporting passage, and in the case of dispensing no coin from the accommodating portion, the projection projects from the dispensing and transporting face in accordance with closing operation of the opening/closing member to the dispensing port, regulates transportation of coins to the dispensing and transporting passage and returns the coins to the accommodating portion.

According to a coin processing machine of the present invention, in addition to the effect of the coin processing machine above, coins can be accommodated with the coins not aligned and reliably dispensed one by one, because the dispensing unit includes: a rotary disc which is rotated at a position tilted at a predetermined angle in relation to a horizontal direction; and a hopper for pooling coins between the hopper and a surface side of the rotary disc with the coins not aligned, and a plurality of picking-up members projecting from the surface of the rotary disc lock and sending coins to the dispensing and transporting passage by rotation of the rotary disc. When dispensing of a predetermined number of coins is detected by a detecting unit, the rotary disc is continuously rotated, the dispensing port is closed by the opening/closing member, and the projection is projected from the dispensing and transporting face to regulate dispensing of coins. Additionally, when a coin not recognized as a normal coin by a recognition unit exists, a coin can be promptly additionally dispensed, because the projection is retracted under the dispensing and transporting face in accordance with the opening operation of the opening/closing member to a dispensing port, coins are allowed to be transported to the dispensing and transporting passage, and the rotary disc is continuously rotated until completion of dispensing of a predetermined number of normal coins.

According to a coin processing machine of the present invention, in addition to the effect of the coin processing machine above, coins put in a coin receiving port from the outside of a machine body are fed one by one by a feeding unit to a transporting unit, a coin recognized as a normal coin by a recognition unit can be sorted and accommodated into the corresponding coin dispensing device through the dispensing port by a sorting member, and the projection moves with the opening/closing member and sorting member so as to reliably act in accordance with dispensing and accommodating of coins.

According to a coin processing machine of the present invention, in addition to the effect of the coin processing machine of above, coins put in the coin receiving port are received in the feeding unit, fed one by one, transported by the transporting unit and recognized by the recognition unit, a coin recognized as a normal coin is transported to the corresponding coin dispensing device through the dispensing port, and a coin other than a normal coin is transported to a coin dispensing port and can be returned.

According to a coin processing machine of the present invention, in addition to the effect of the coin processing machine above, coins put in the coin receiving port from the outside of the machine body are fed one by one by the feeding unit to the transporting unit and recognized as the recognition unit, and normal coins can be temporarily stored in an escrow unit. Additionally, when an accommodating instruction is received from the outside of the machine body, coins in the escrow unit are sent to the feeding unit and fed one by one by the feeding unit to the transporting unit, a coin recognized as a normal coin by the recognition unit can be sorted and accommodated into the corresponding coin dispensing device through the dispensing port by the sorting member, and a coin not recognized as a normal coin can be collected into a coin cassette.

According to a coin processing machine of the present invention, in addition to the effect of the coin processing machine above, when a depositing instruction is received from the outside of the machine body, coins received in the feeding unit are fed one by one, transported by the transporting unit and recognized by the recognition unit, normal coins are transported and stored into the escrow unit, and coins other than normal coins are transported to the coin dispensing port and can be returned; when an accommodating instruction is received from the outside of the machine body after the depositing instruction, coins in the escrow unit are sent to the feeding unit, fed one by one, transported by the transporting unit and recognized by the recognition unit, a coin recognized as a normal coin is transported to the coin cassette in the case where the corresponding coin dispensing device is in a full state, or can be accommodated in the corresponding coin dispensing device through the dispensing port in the case of being not in the full state, and a coin not recognized as a normal coin can be transported to the coin cassette; and when a returning instruction is received from the outside of the machine body after the depositing instruction, coins in the escrow unit are sent to the feeding unit, fed one by one and transported by the transporting unit, and all coins are transported to the coin dispensing port and can be returned.

DETAILED DESCRIPTION OF THE INVENTION

Hereinafter, an embodiment of the present invention will be described with reference to the drawings. Moreover, the embodiment is only cited as an example, and does not limit the scope of the present invention.

Figure 5:
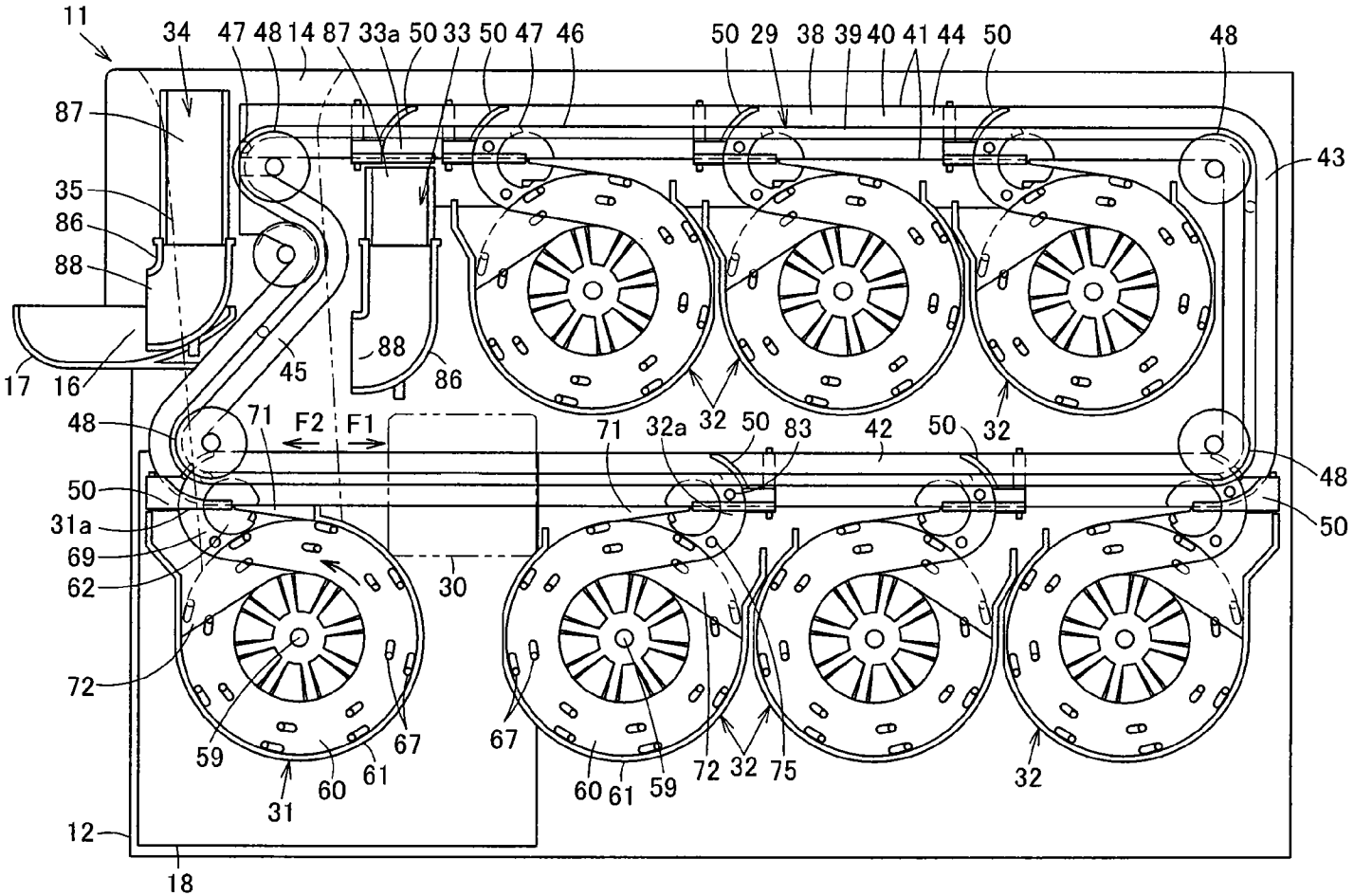
FIG. 5 is a side view showing an inner structure of a coin processing machine using the coin dispensing devices.
Figure 6:
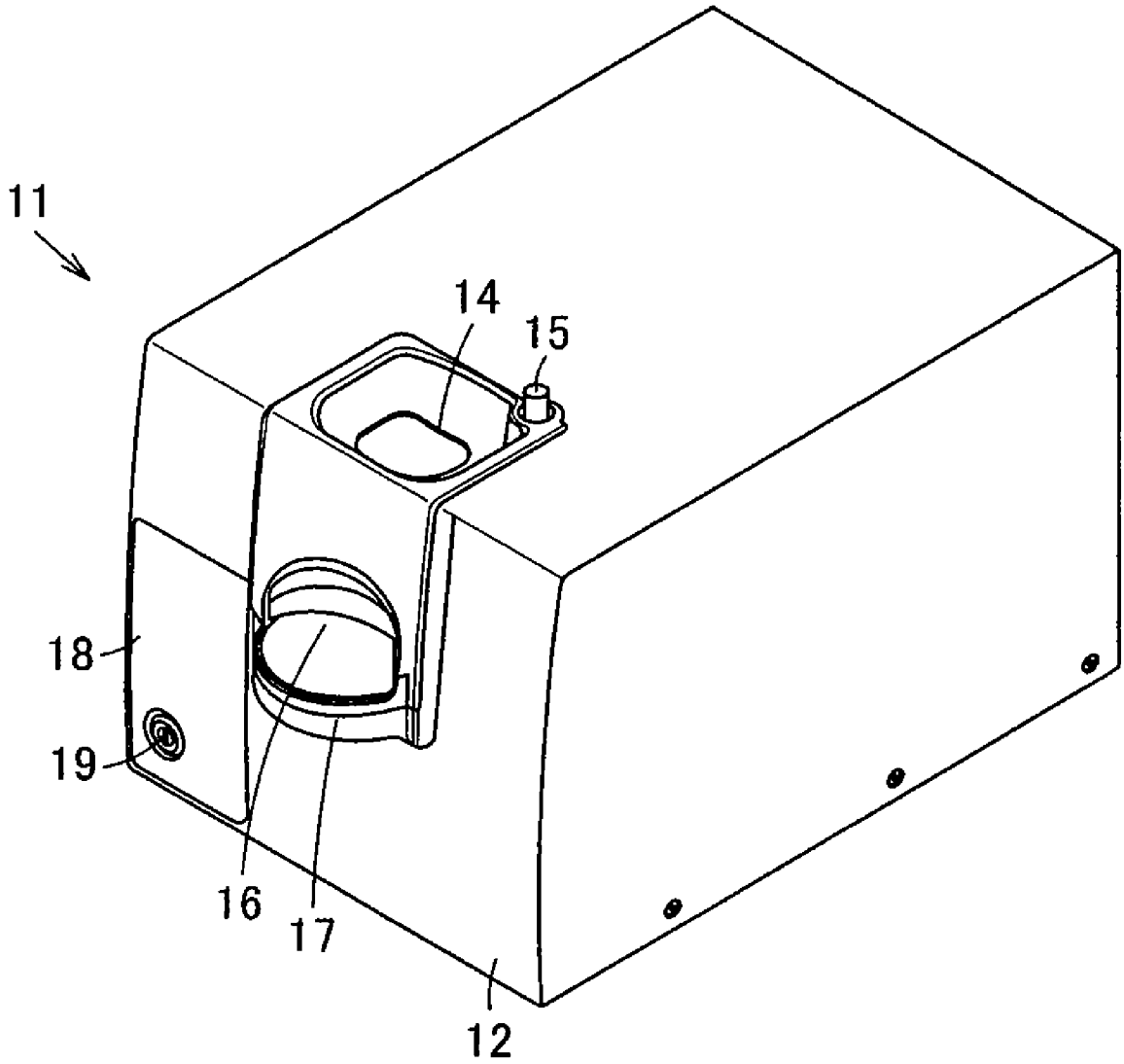
FIG. 6 is a perspective view of the coin processing machine.

As shown in FIGS. 5 and 6, a coin depositing and dispensing machine 11 as a coin processing machine is an automatic change dispenser enabling depositing of coins paid by customers and dispensing change to be paid to customers in, for example, a shop.

The coin depositing and dispensing machine 11 includes a machine body 12, a front face (left side in FIGS. 5 and 6) of the machine body 12 is set as an operation face for customers, and a rear face (right side in FIGS. 5 and 6) of the machine body 12 is set as an operation face for cashiers. In this case, a customer deposits coins to be paid and receives dispensed change by himself/herself, it is not required to constantly arrange cashiers for the coin depositing and dispensing machine 11, and cost reduction is realized in a shop to which the coin depositing and dispensing machine 11 is introduced.

Additionally, the front face (left side in FIGS. 5 and 6) of the machine body 12 may be set as an operation face for cashiers, and the rear face (right side in FIGS. 5 and 6) of the machine body 12 may be set as an operation face for customers. In this case, it is required to arrange cashiers for the coin depositing and dispensing machine 11. However, a cashier deposits coins paid by customers and receives change to be paid to customers, and thus delivery and receipt of cash is visually checked by the customer and cashier and can be more reliably performed.

A coin receiving port 14 for putting coins into the machine body 12 and a deposit starting button 15 for starting depositing operation are disposed at a front upper face of the machine body 12.

A coin dispensing port 16 for dispensing coins to the outside of the machine body 12 and a front dispensing tray 17 for receiving coins dispensed from the coin dispensing port 16 are disposed at the front face of the machine body 12. Further, a coin cassette 18 removable from the machine body 12 is disposed at the front face of the machine body 12. A locking portion 19 for locking/unlocking the coin cassette 18 by key operation with the cassette 18 attached to the machine body 12 is provided in the coin cassette 18.

As shown in FIG. 5, a base (not shown), of which an upper part is tilted, at a predetermined angle, leftward viewed from the front face of the machine body 12, is disposed in the machine body 12, and a circular transporting unit 29 for transporting coins is disposed on a surface side directed upward of the base. A recognition unit 30 for properly selecting and recognizing at least a denomination, authenticity, fatigue, etc., of a coin transported by the transporting unit 29 is disposed on the transporting unit 29, and the following portions are disposed so as to be connected to each other through the transporting unit 29: a pooling and feeding portion 31 which is a feeding unit as a coin dispensing device capable of receiving coins put in the coin receiving port 14, feeding coins one by one to the transporting unit 29 and making coins enter/exit the transporting unit 29 one by one; a plurality of accommodating and dispensing portions 32 as coin dispensing devices for accommodating coins for each denomination and capable of making coins enter/exit the transporting unit 29 one by one; an escrow unit 33 capable of temporarily storing coins to be deposited; and a dispensing escrow unit 34 capable of temporarily storing coins to be dispensed. A receiving chute 35 for introducing coins put in the coin receiving port 14 to the pooling and feeding portion 31 is disposed between the coin receiving port 14 and pooling and feeding portion 31.

The transporting unit 29 includes a circular coin passage 38 for aligning and guiding coins to be transported, and an endless transporting body 39 for transporting coins in the coin passage 38.

The coin passage 38 includes a passage face 40 which is formed on the surface of the base and with which a surface of a coin comes into contact, and guide side plates 41 on both sides for guiding a circumference of a coin at both sides of the passage face 40. In the coin passage 38, the following portions are formed: a first passage portion 42 provided from the front side to the rear side of the machine body 12; a turning passage portion 43 provided along the rear face of the machine body 12 so that the coin passage is turned from a rear end of the first passage portion 42 to the front side of the machine body 12; a second passage portion 44 which leads from the turning passage portion 43 to the front side of the machine body 12 and has a front end directed to the dispensing escrow unit 34; and a dispensing passage portion 45 provided so as to be directed to the dispensing escrow unit 34 in parallel with the front end of the second passage portion 44 from a front end of the first passage portion 42.

The transporting body 39 is constituted by an endless belt 46, and a plurality of projections 47 are projected from a face, which faces the passage face 40, of the belt 46 at a predetermined pitch in a longitudinal direction of the belt. The belt 46 is stretched by a plurality of pulleys 48 so as to be rotated through a central region of the coin passage 38. A coin is received between the adjacent projections 47 of the belt 46, pushed and transported by the projections 47 by rotation of the belt 46. Additionally, the pulleys 48 are normally and reversely rotated by a motor, and thus the belt 46 is normally and reversely rotated. In depositing, etc., in which coins are fed from the pooling and feeding portion 31 and accommodated into the accommodating and dispensing portions 32, the belt 46 is rotated in a first direction (hereinafter, referred to as a depositing and transporting direction F1) which is a normal direction where coins are moved from the front side to rear side in the first passage portion 42. On the other hand, at the time of dispensing, etc., in which coins are fed from the accommodating and dispensing portions 32 and dispensed to the coin dispensing port 16, the belt 46 is rotated in a second direction (hereinafter, referred to as a dispensing and transporting direction F2) reverse to the depositing and transporting direction F1. Therefore, normal and reverse rotation of the belt 46 enables coins in the coin passage 38 to be transported in normal and reverse directions.

At the lower side of the first passage portion 42 of the coin passage 38, the pooling and feeding portion 31 is disposed on the front side and the plurality of, for example, three accommodating and dispensing portions 32 are disposed, along the first passage portion 42, behind the pooling and feeding portion 31. The recognition unit 30 is disposed between the pooling and feeding portion 31 and foremost accommodating and dispensing portion 32. Additionally, at the lower side of the second passage portion 44, the plurality of, for example, three accommodating and dispensing portions 32 are disposed along the second passage portion 44, and the escrow unit 33 is disposed in front of the accommodating and dispensing portions 32. The dispensing escrow unit 34 is disposed facing the front end of the second passage portion 44 and a front end of the dispensing passage portion 45.

Additionally, a coin inlet/outlet 31*a* as a dispensing port of the pooling and feeding portion 31 and a coin inlet/outlet 32*a* as a dispensing port of each accommodating and dispensing portion 32, through which coins enter/exit the coin passage 38, are formed in a manner that apart of each of the corresponding guide side plates 41 on the lower side of the first and second passage portions 42, 44 is opened. A coin inlet 33*a* of the escrow unit 33 capable of receiving coins from the coin passage 38 is formed in a manner that a part of the guide side plate 41 on the lower side of the second passage portion 44 is opened.

Gate members 50, which selectively sort coins in accordance with whether making coins enter/exit the coin inlet/outlet 31*a* and each coin inlet/outlet 32*a* or making coins transported by the transporting unit 29 pass to the downstream side in a transporting direction, are disposed at the coin inlet/outlet 31*a* of the pooling and feeding portion 31 and each coin inlet/outlet 32*a* of the accommodating and dispensing portion 32 aside of the coin passage 38. Further, another gate member 50, which selectively sorts coins in accordance with whether deviating coins or making coins transported by the transporting unit 29 pass to the downstream side in the transporting direction, is disposed at the coin inlet 33*a* of the escrow unit 33. These gate members 50 have the same basic structure and operation of sorting coins, except for direction, etc.

The gate member 50 for accommodating and dispensing portions 32 will be described with reference to FIGS. 1 to 4. The gate member 50 integrally includes: a coin guiding portion 51 for guiding coins (indicated by the symbol C in FIG. 1) between the coin passage 38 and coin inlet/outlet 32*a*; a closing portion 52 for opening/closing the coin inlet/outlet 32*a*; and a holding portion 53 for holding the coin guiding portion 51 and closing portion 52 swingably. The gate member 50 is integrally formed with sorting members for sorting coins to the accommodating and dispensing portion 32 through the coin inlet/outlet 32*a* and opening/closing members for opening/closing the coin inlet/outlet 32*a*.

The coin guiding portion 51 is provided so that one side, at which the coin inlet/outlet 32*a* side of the coin guiding portion 51 is located, in a width direction crossing a passage direction of the coin passage 38, a lower side, of the coin guiding portion 51 is tilted, at a predetermined angle, to the downstream side in a transporting direction when the transporting unit 29 is driven in the depositing and transporting direction F1, in relation to the other side, which is located opposite from the coin inlet/outlet 32*a*, in the width direction of the coin passage 38, an upper side, of the coin guiding portion 51. Additionally, the coin guiding portion 51 is provided in the shape of a recessed-face facing the upstream side in the transporting direction when the transporting unit 29 is driven in the depositing and transporting direction F1.

A guide face 54, which becomes flush with the lower guide side plate 41 and guides the circumference of a coin when the closing portion 52 is closed, is provided in the closing portion 52.

The holding portion 53 is located at the downstream side, in relation to the coin guiding portion 51 and closing portion 52, in the depositing and transporting direction F1, turnable around both sides axes 53*a*, as a fulcrum, projecting in the width direction of the coin passage 38, and driven by an electric driving unit such as a solenoid. When coins are sorted from the coin passage 38 to the accommodating and dispensing portion 32 and dispensed from the accommodating and dispensing portion 32 to the coin passage 38, the coin guiding portion 51 is projected from the passage face 40 of the coin passage 38 and the gate member 50 is located at a coin sorting position (or coin dispensing position) where the coin inlet/outlet 32*a* is opened by the closing portion 52. On the other hand, when coins are not sorted from the coin passage 38 to the accommodating and dispensing portion 32 and are not dispensed from the accommodating and dispensing portion 32 to coin passage 38, the coin guiding portion 51 is retracted under the passage face 40 of the coin passage 38 and the gate member 50 is located at a coin passing position where the coin inlet/outlet 32*a* is closed by the closing portion 52. An opening, through which the coin guiding portion 51 enters/exits the coin passage 38, is formed in the passage face 40 of the coin passage 38. A groove portion 55 for preventing the coin guiding portion 51 projecting from the coin passage 38 from interfering with the belt 46 is formed in the coin guiding portion 51 of the gate member 50.

Moreover, each of the gate members 50 of the pooling and feeding portion 31, escrow unit 33 and collection coin dispensing port 20 includes a coin guiding portion 51, closing portion 52 and holding portion 53 similar to those of the gate member 50 of the accommodating and dispensing portion 32, and is driven by an electric driving unit. Additionally, these gate members 50 have the same basic structure and operation of sorting coins one by one to the transporting unit 29, except the direction in the transporting direction.

Figure 1:
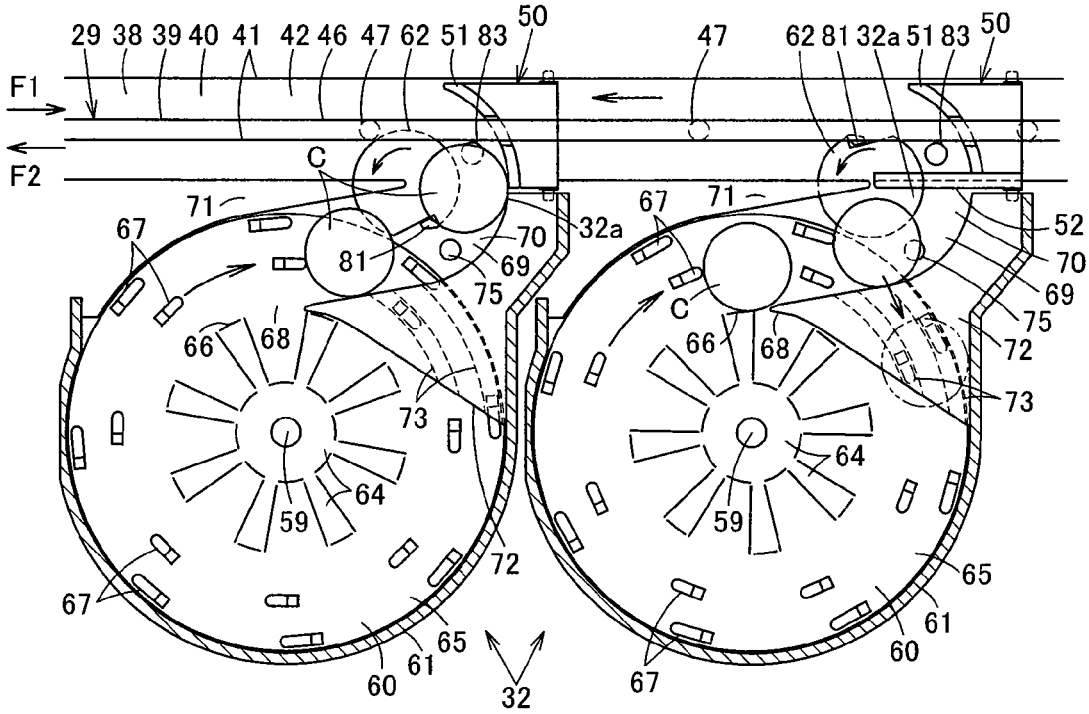
FIG. 1 is a front view of a coin dispensing device of an embodiment of the present invention.
Figure 2:
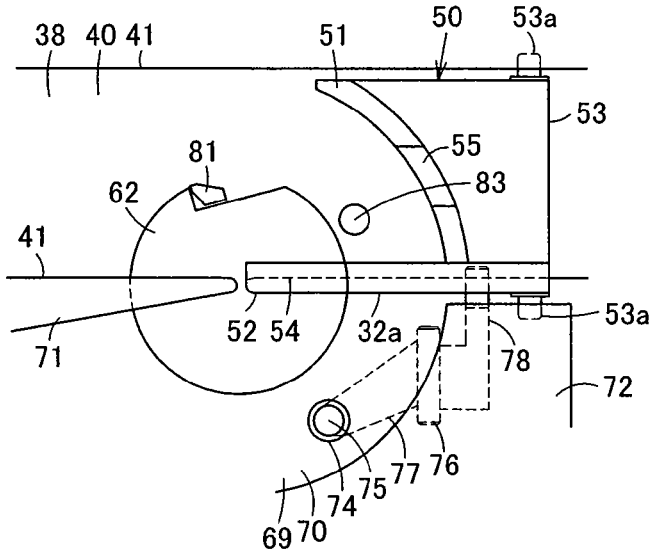
FIG. 2 is an enlarged front view of the coin dispensing device.

FIG. 1 shows the structure of the accommodating and dispensing portion 32 disposed aside of the first passage portion 42. The accommodating and dispensing portion 32 includes: a rotary disc 60 rotatable around a rotary axis 59 at a position tilted at a predetermined angle in relation to a horizontal direction; a hopper 61 as an accommodating portion for pooling coins between the hopper 61 and a surface side of the rotary disc 60; a delivering disc 62 arranged in the vicinity of the coin inlet/outlet 32*a*; and the like.

Viewing from the front face of the machine body 12, the rotary disc 60, by the rotary axis 59 rotatably attached to the machine body 12, is tilted rightward in relation to the horizontal direction, has a left side higher than a right side, and is disposed so that the surface of the rotary disc 60 is directed to the right upper side of the machine body 12. The rotary disc 60 is interlocked with the belt 46 and delivering disc 62, and rotation-driven by a motor in a feeding and rotating direction (indicated by an arrow in FIG. 1) of feeding coins to the coin passage 38. The rotary disc 60 may be made rotatable in a reverse feeding and rotating direction reverse to the feeding and rotating direction so that a coin jam is removed in occurrence of the coin jam.

A high portion 64 is formed at the center of the surface of the rotary disc 60, and an annular low portion 65 is formed at an outer circumferential region of the high portion 64. Stage-shaped coin circumference holding portions 66, each which has a size slightly smaller than the thickness of the smallest coin among coins to be handled and each on which a circumference of one coin is mounted in its thickness direction, are provided between the high portion 64 and low portion 65 of the rotary disc 60.

A plurality of picking-up members 67 projecting from the surface of the rotary disc 60 are arranged on the lower portion 65 at a predetermined pitch in two lines in inner and outer circumferential directions. When the rotary disc 60 is rotated in the feeding and rotating direction, each picking-up members 67 on the inner circumferential side holds one coin between the picking-up member 67 and the coin circumference holding portion 66 and picks up the coin to an upper region of the rotary disc 60, and each picking-up member 67 on the outer circumferential side pushes the coin, which is picked up to the upper region of the rotary disc 60 by each picking-up member 67 on the inner circumferential side, to the coin inlet/outlet 32*a* and delivers it to the delivering disc 62.

The coin circumference holding portion 66 is provided for each position where one coin can be held between the coin circumference holding portion 66 and each picking-up member 67. Therefore, the plurality of coin circumference holding portions 66 are provided in the circumferential direction. A sliding-down portion 68 is formed between the coin circumference holding portions 66, the sliding-down portion 68 sliding coins, which cannot be held between the picking-up member 67 and coin circumference holding portion 66, downward on a tilted surface constituted by a difference in level between the high portion 64 and low portion 65.

A dispensing and transporting passage 69 for feeding coins picked up to the upper region of the rotary disc 60 by the picking-up members 67 to the coin inlet/outlet 32*a* is formed at the upper region of the rotary region 60. The dispensing and transporting passage 69 is formed between a dispensing and transporting face 70, which is flush with the surface of the rotary disc 60 and continues to the coin passage 38, and upper and lower guide members 71 and 72.

The upper guide member 71 is formed from the upper region of the rotary disc 60 to one edge side of the coin inlet/outlet 32*a* so as to be projected from the surfaces of the rotary disc 60 and dispensing and transporting face 70.

The lower guide member 72 is provided from the coin circumference holding portion 66 side to the other edge side of the coin inlet/outlet 32*a* in a state of facing a surface of the low portion 65 at an interval that no coins enter. An inner edge, which faces the inside of the dispensing and transporting passage 69, of the guide member 72 is curvedly formed so as to continue to the coin guiding portion 51 of the gate member 50. A groove portion 73, through which rotationally moved picking-up members 67 pass, is formed in a surface, which faces the low portion 65, of the guide member 72. By the guide member 72, coins picked up by the picking-up members 67 are received from the coin circumference holding portions 66 and guided to the coin inlet/outlet 32*a*.

Figure 3:
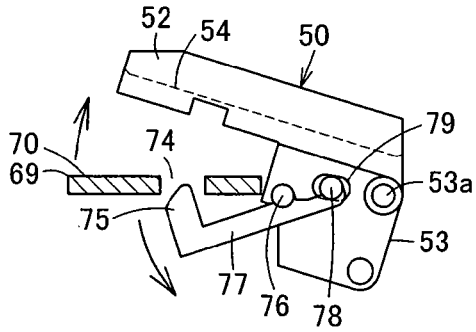
FIG. 3 is a bottom view showing operation of a projection and opening/closing member in the case where the coin dispensing device dispenses coins.
Figure 4:
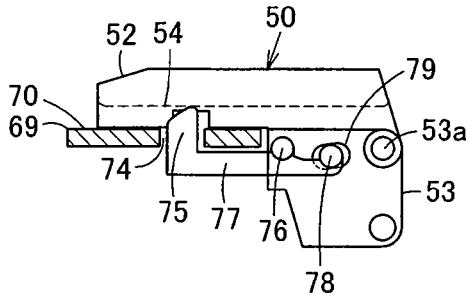
FIG. 4 is a bottom view showing operation of the projection and opening/closing member in the case where the coin dispensing device dispenses no coin.

A hole portion 74 is formed in the dispensing and transporting passage 69, and a projection 75 capable of vertically projecting from/retracting under the dispensing and transporting face 70 is arranged at the hole portion 74. The projection 75 is, at the lower side of the dispensing and transporting passage 69, projected from one end of a lever 77 which is supported swingably around an axis 76, as a fulcrum, parallel with the axis 53*a* of the gate member 50. A connection axis 78 is provided at the other end of the lever 77, and connected to a connection hole 79 of the holding portion 53 of the gate member 50. Thus, as shown in FIG. 3, the projection 75 retracts under the dispensing and transporting face 70 and allows coins sent from the rotary disc 60 to the dispensing and transporting passage 69 to be transported, in accordance with opening operation that the closing portion 52 of the gate member 50 swung to the coin dispensing position opens the coin inlet/outlet 32*a*. Additionally, as shown in FIG. 4, the projection 75 projects from the dispensing and transporting face 70, comes into contact with coins sent from the rotary disc 60 to the dispensing and transporting passage 69, regulates transportation of the coins, drops the coins from the lower guide member 72 and returns the coins to the accommodating and dispensing portion 32, in accordance with closing operation in which the closing portion 52 of the gate member 50 swung to the coin passing position closes the coin inlet/outlet 32*a*. Additionally, the projection 75 is columnarly formed, the top face thereof is formed in a tilt or arc shape so as to descend to the upstream side in the transporting direction, the rotary disc 60 side. Even in a state where the projection 75 projects from the dispensing and transporting face 70, no coin impacts with a circumference face of the projection 75 and coins can be smoothly dropped.

Moreover, interlocking between the projection 75 and gate member 50 is not limited to mechanical interlocking, and may be electrical interlocking for interlocking them by adjusting the driving timings of these even in the case where the projection 75 and gate member 50 are respectively driven by different driving sources.

The hopper 61 faces and covers the surface side of the rotary disc 60, has one side face which is the surface of the rotary disc 60, pools coins with the coins not aligned and is opened upward so as to receive coins from the coin inlet/outlet 32*a*.

The delivering disc 62 is rotatably arranged in a space, which is obtained by notching a part of the dispensing and transporting passage 69 and a part of the coin passage 38, so that a surface of the delivering disc 62 is flush with the surface of the rotary disc 60, passage face 40 and dispensing and transporting face 70. A projection 81 for coming into contact with and feeding coins from the rotary disc 60 side to the coin passage 38 through the dispensing and transporting passage 69 is projected on an outer circumference of the delivering disc 62. The delivering disc 62 is interlocked and rotated with the belt 46 of the coin passage 38, rotated, when the belt 46 moves in the dispensing and transporting direction F2, in a feeding and rotating direction where the projection 81 moves from the dispensing and transporting passage 69 into the coin passage 38 through the coin inlet/outlet 32*a*, that is, in a feeding and rotating direction where coins are fed from the rotary disc 60 side to the coin passage 38 through the dispensing and transporting passage 69 by the projection 81, and rotated, when the belt 46 moves in the depositing and transporting direction F1, in a reverse feeding and rotating direction where the projection 81 moves from the coin passage 38 side into the dispensing and transporting passage 69 through the coin inlet/outlet 32*a*.

Additionally, a detecting unit 83 for detecting coins dispensed from the coin inlet/outlet 32*a* and coins transported in the coin passage 38 is disposed at the passage face 40, which faces the coin inlet/outlet 32*a*, of the coin passage 38.

Moreover, since the transporting direction of coins of the first passage portion 42 is opposite to that of the second passage portion 44, a direction of each accommodating and dispensing portion 32 provided aside of the second passage portion 44 is opposite to that provided aside of the first passage portion 42. However, both the accommodating and dispensing portions 32 have the same basic structure. Additionally, although a direction of the pooling and feeding portion 31 is opposite to that of each accommodating and dispensing portion 32 provided aside of the first passage portion 42, both portions have the same basic structure. The delivering disc 62 is rotated in the feeding and rotating direction when the belt 46 moves in the depositing and transporting direction F1, and rotated in the reverse feeding and rotating direction when the belt 46 moves in the dispensing and transporting direction F2. Additionally, a foreign object discharge gate (not shown) for discharging a foreign object, which the rotary disc 60 cannot feed and remains in the hopper 61, is openably/closably disposed at a lower part of the hopper 61 of the pooling and feeding portion 31.

As in FIG. 5, the escrow unit 33 is disposed above the coin cassette 18 and pooling and feeding portion 31, and includes a chute portion 86. The chute portion 86 is hollow and cylindrical, a horizontal opening 87 for receiving coins sorted from the coin passage 38 by the gate member 50 is formed in an upper region of the chute portion 86, an opening 88 opened sideward is formed in a lower region of the chute portion 86, and the chute portion 86 is formed so that its lower side is curved toward the opening 88.

The chute portion 86 has an upper cylindrical portion attached to the machine body 12, and a lower cylindrical portion rotatably attached to a lower side of the upper cylindrical portion, and the lower cylindrical portion of the chute portion 86 is rotatable around a vertical axis passing through the center of the upper cylindrical portion. A closing member (not shown), which closes the opening 88 in the lower region of the chute portion 86 when the chute portion 86 is located at a predetermined rotation position which is a storage position, is disposed on a circumference of a rotation region in which the opening 88 in the lower region of the chute portion 86 is rotated. Coins sent from the opening 87 in the upper region are temporarily stored in the chute portion 86 at the storage position of the chute portion 86 in which the opening 88 in the lower region is closed by the closing member, and ejected to the pooling and feeding portion 31 by rotation of the chute portion 86 in one side direction in relation to the closing member, or to the coin cassette 18 by rotation of the chute portion 86 in the other side direction in relation to the closing member.

The dispensing escrow unit 34 disposed above the dispensing tray 17, can receive coins from its upper part, the coins being ejected from the second passage portion 44 or dispensing passage portion 45 of the coin passage 38, and has the same basic structure as that of the escrow unit 33. Coins sent from an opening 87 in an upper region are temporarily stored in a chute portion 86 at a storage position, where an opening 88 in a lower region is closed by a closing member, of the chute position 86, and ejected to the coin dispensing port 16 by rotation of the chute portion 86 in one side direction in relation to the closing member, or to the coin cassette 18 by rotation of the chute portion 86 in the other side direction in relation to the closing member.

The coin depositing and dispensing machine 11 includes a controlling portion (not shown). The controlling portion has various functions of controlling the coin depositing and dispensing machine 11. Some functions having features will be described below.

In a function of a controlling unit, when dispensing of a predetermined number of coins necessary for dispensing is detected by the detecting unit 83, the coin inlet/outlet 32*a* is closed by the gate member 50 and the projection 75 is projected from the dispensing and transporting passage 69. More specifically, in the function of the controlling unit, when dispensing of a predetermined number of coins necessary for dispensing is detected by the detecting unit 83, the rotary disc 60 is continuously rotated, the coin inlet/outlet 32*a* is closed by the gate member 50, and the projection 75 is projected from the dispensing and transporting face 70 to regulate dispensing of coins, and when a coin not recognized as a normal coin by the recognition unit 30 exists, the projection 75 is retracted under the dispensing and transporting face 70 in accordance with the opening operation of the gate member 50 to the coin inlet/outlet 32*a*, coins are allowed to be transported to the dispensing and transporting passage 69, and the rotary disc 60 is continuously rotated until completion of dispensing of a predetermined number of normal coins.

In a function of a depositing controlling portion, when a depositing instruction is received from the outside of the machine body 12, coins received in the pooling and feeding portion 31 are fed one by one, transported by the transporting unit 29 and recognized by the recognition unit 30, normal coins are transported to the escrow unit 33, and coins other than normal coins are transported to the coin dispensing port 16.

In a function of an accommodation controlling portion, when an accommodating instruction is received from the outside of the machine body 12 after the depositing instruction, coins in the escrow unit 33 are sent to the pooling and feeding portion 31, fed one by one, transported by the transporting unit 29 and recognized by the recognition unit 30, a coin recognized as a normal coin is transported to the coin cassette 18 in the case where the corresponding accommodating and dispensing portion 32 is in a full state, or accommodated in the corresponding accommodating and dispensing portion 32 through the coin inlet/outlet 32*a* in the case of not being in the full state, and a coin not recognized as a normal coin by the recognition unit 30 is transported to the coin cassette 18.

In a function of a return controlling portion, when a returning instruction is received from the outside of the machine body 12 after the depositing instruction, coins in the escrow unit 33 are sent to the pooling and feeding portion 31, fed one by one and transported by the transporting unit 29, and all coins are transported to the coin dispensing port 16.

Next, operation of the coin depositing and dispensing machine 11 will be described.

Depositing operation will be first described.

Coins to be deposited put in the coin receiving port 14 are collectively received and pooled in the pooling and feeding portion 31.

When a depositing instruction is issued by operation of the deposit starting button 15, the pooling and feeding portion 31 and transporting unit 29 are driven.

Thus, coins in the pooling and feeding portion 31 are fed one by one to the coin passage 38, transported one by one by the belt 46 in the depositing and transporting direction F1, and recognized by the recognition unit 30.

Coins recognized as normal coins as a result of recognition by the recognition unit 30 are sorted to the escrow unit 33 by the gate member 50 at the position of the escrow unit 33, and stored in the chute portion 86 which is rotated and arranged to the storage position in advance and in which the opening 88 in the lower region is closed by the closing member.

Coins not recognized as normal coins as a result of recognition by the recognition unit 30 are transported to the front end, which is a terminal end, of the second coin passage portion 44, ejected to the dispensing escrow unit 34, ejected to the dispensing tray 17 through the chute portion 86, which is rotated and arranged to an ejecting position to the coin dispensing port 16 in advance, and returned from the coin dispensing port 16.

When an accommodating instruction is issued after escrow of coins to be deposited, the chute portion 86 of the escrow unit 33 is rotated from the storage position to an ejecting position to the pooling and feeding portion 31, and coins stored in the chute portion 86 of the escrow unit 33 are sent to the pooling and feeding portion 31.

Then, the pooling and feeding portion 31 and transporting unit 29 are driven. Thus, coins in the pooling and feeding portion 31 are fed one by one to the coin passage 38, transported one by one by the belt 46 in the depositing and transporting direction F1, and recognized by the recognition unit 30.

A coin recognized as a normal coin as a result of recognition by the recognition unit 30 is sorted, by the gate member 50 of the accommodating and dispensing portion 32 for accommodating the coin of the corresponding denomination, from the coin passage 38 to the coin inlet/outlet 32*a* of the accommodating and dispensing portion 32, and accommodated into the accommodating and dispensing portion 32.

In the corresponding accommodating and dispensing portion 32, the gate member 50 is activated, the closing portion 52 retreats from the coin inlet/outlet 32*a* and opens the coin inlet/outlet 32*a* and the coin guiding portion 51 projects into the coin passage 38, the projection 75 retracts under the dispensing and transporting passage 69 in accordance with the movements of the closing portion 52 and coin guiding portion 51, and coins are allowed to be received. Thus, the corresponding coins transported in the coin passage 38 are taken into the coin inlet/outlet 32*a* by the gate member 50, dropped and accommodated into the hopper 61.

Coins, which have been recognized as normal coins once but are not recognized as normal coins as a result of recognition by the recognition unit 30, are made to pass each accommodating and dispensing portion 32 aside of the coin passage 38, sorted to the escrow unit 33 by the gate member 50 of the escrow unit 33, and sent and accommodated into the coin cassette 18 through the chute portion 86 which is rotated and arranged to an ejecting position to the coin cassette 18 side.

When the number of coins accommodated in the accommodating and dispensing portion 32 reaches a predetermined full number, coins of the corresponding denomination transported thereafter are handled as overflow coins, made to pass each accommodating and dispensing portion 32 aside of the coin passage 38, sorted to the escrow unit 33 by the gate member 50 of the escrow unit 33, and sent and accommodated into the coin cassette 18 through the chute portion 86 which is rotated and arranged to the ejecting position to coin cassette 18 side in advance.

When temporarily stored coins to be deposited are completely accommodated in the accommodating and dispensing portions 32 or coin cassette 18, a depositing process is ended.

When a returning instruction is issued after escrow of coins to be deposited, the chute portion 86 of the escrow unit 33 is rotated from the storage position to the ejecting position to the pooling and feeding portion 31, and coins temporarily stored in the chute portion 86 of the escrow unit 33 are sent to the pooling and feeding portion 31.

Then, the pooling and feeding portion 31 and transporting unit 29 are driven. Thus, coins in the pooling and feeding portion 31 are fed one by one to the coin passage 38, transported one by one by the belt 46 in the depositing and transporting direction F1, ejected from the front end, which is the terminal end, of the second passage portion 44 of the coin passage 38 to the dispensing escrow unit 34, ejected to the coin dispensing port 16 through the chute portion 86, which is rotated and arranged to the ejecting position to the coin dispensing port 16 in advance, and returned from the dispensing tray 17.

Next, dispensing operation will be described.

When a dispensing instruction regarding the denominations and number of coins to be dispensed or dispensing amount is received, the corresponding accommodating and dispensing portion 32 accommodating coins to be dispensed and transporting unit 29 are driven.

Thus, coins in the corresponding accommodating and dispensing portion 32 are fed one by one to the coin passage 38, transported one by one by the belt 46 in the dispensing and transporting direction F2, and recognized by the recognition unit 30. In the case where coins to be dispensed are dispensed from the plurality of accommodating and dispensing portions 32, coins to be dispensed are dispensed from any one of the accommodating and dispensing portion 32, and then coins to be dispensed are successively dispensed from the other accommodating and dispensing portions 32. Moreover, since the timings of feeding coins in the accommodating and dispensing portions 32 to the coin passage 38 are adjusted and the corresponding plurality of accommodating and dispensing portions 32 can be simultaneously operated, coins fed to the coin passage 38 can be prevented from interfering with the gate member 50 of the other accommodating and dispensing portion 32.

In the corresponding accommodating and dispensing portion 32, the gate member 50 is activated, the closing portion 52 retreats from the coin inlet/outlet 32*a* and opens the coin inlet/outlet 32*a* and the coin guiding portion 51 projects into the coin passage 38, the projection 75 retracts under the dispensing and transporting passage 69 in accordance with the movements of the closing portion 52 and coin guiding portion 51, and coins are allowed to be dispensed. Thus, coins, which are picked up from the inside of the hopper 61 by the picking-up members 67, are sent to the dispensing and transporting passage 69 by rotation of the rotary disc 60, fed to the coin passage 38 through the dispensing and transporting passage 69 by the projection 81 of the delivering disc 62, and delivered to the projections 47 of the belt 46 of the coin passage 38. The coins dispensed to the coin passage 38 are detected by the detecting unit 83 and counted by the controlling portion.

Additionally, in the corresponding accommodating and dispensing portion 32, when dispensing of a predetermined number of coins necessary for dispensing is detected, the gate member 50 is activated, the coin inlet/outlet 32*a* is closed, the projection 75 is projected from the dispensing and transporting passage 69, and coins sent thereafter from the rotary disc 60 to the dispensing and transporting passage 69 are dropped and returned into the hopper 61 by the projection 75. Although rotation of the rotary disc 60 may be stopped here, coins can be promptly additionally dispensed by continuously rotating the rotary disc 60.

Coins recognized as normal coins as a result of recognition by the recognition unit 30 are transported to the front end, which is a terminal end, of the dispensing passage portion 45, ejected to the dispensing escrow unit 34, and stored in the chute portion 86 which is rotated and arranged to the storage position in advance and in which the opening 88 in the lower region is closed by the closing member.

Coins not recognized as normal coins as a result of recognition by the recognition unit 30 are sorted and accommodated from the coin passage 38 into the pooling and feeding portion 31 by the gate member 50 of the pooling and feeding portion 31. Since the denomination of a coin not recognized as a normal coin is recognized based on the timing of dispensing from the accommodating and dispensing portion 32 and the timing that the coin reaches the recognition unit 30 by transportation of the belt 46, one coin is additionally dispensed from the accommodating and dispensing portion 32 corresponding to the denomination of the coin.

As described above, when a coin not recognized as a normal coin by the recognition unit 30 exists, a coin can be promptly additionally dispensed by continuously rotating the rotary disc 60, because by activating the gate member 50, the projection 75 retracts under the dispensing and transporting face 70 in accordance with the opening operation of the gate member 50 to the coin inlet/outlet 32*a* and coins are allowed to be transported to the dispensing and transporting passage 69.

In the case where coins are dispensed from the plurality of accommodating and dispensing portions 32, the rotary discs 60 of the accommodating and dispensing portions 32 are simultaneously rotated. Thus, for example, only by switching, when dispensing of coins from any one of the accommodating and dispensing portions 32 is completed, operation of the gate member 50 of the accommodating and dispensing portion 32, from which coins have been already dispensed, to operation of the gate member 50 of the accommodating and dispensing portion 32 for subsequently dispensing coins, the accommodating and dispensing portion 32 for dispensing coins is switched, coins of different denominations can be promptly continuously dispensed, and a dispensing processing time can be shortened.

Additionally, in the case where coins are dispensed from the plurality of accommodating and dispensing portions 32, the rotary discs 60 of the plurality of accommodating and dispensing portions 32 are simultaneously rotated and the rotary disc 60 of each accommodating and dispensing portion 32 is continuously rotated even if dispensing of coins from each accommodating and dispensing portion 32 is ended. Thus, even when coins of the plurality of denominations are not recognized as normal coins, coins of necessary denominations can be promptly additionally dispensed only by switching operation of the gate members 50 of the corresponding accommodating and dispensing portions 32, and a dispensing processing time can be prevented from being lengthened.

When coins to be dispensed are stored in the chute portion 86 of the dispensing escrow unit 34, the chute portion 86 is rotated from the storage position to the ejecting position to the coin dispensing port 16, and the coins stored in the chute portion 86 are ejected to the coin dispensing port 16 and dispensed from the dispensing tray 17.

Then, in the case where coins not recognized as normal coins are sorted into the pooling and feeding portion 31, the pooling and feeding portion 31 and transporting unit 29 are driven. Thus, the coins not recognized as normal coins and sorted into the pooling and feeding portion 31 are fed one by one to the coin passage 38, transported one by one by the belt 46 in the depositing and transporting direction F1, and recognized by the recognition unit 30.

A coin recognized as a normal coin as a result of recognition by the recognition unit 30 is sorted from the coin passage 38 to the coin inlet/outlet 32*a* of the accommodating and dispensing portion 32 by the gate member 50 of the accommodating and dispensing portion 32 for accommodating the coin of the corresponding denomination, and accommodated into the corresponding accommodating and dispensing portion 32.

Coins not recognized as normal coins as a result of recognition by the recognition unit 30 are made to pass each accommodating and dispensing portion 32 aside of the coin passage 38, sorted to the escrow unit 33 by the gate member 50 of the escrow unit 33, and sent and accommodated into the coin cassette 18 through the chute portion 86 which is rotated and arranged to the ejecting position to the coin cassette 18 in advance.

Next, collecting operation will be described.

When a collecting instruction is received from the outside, the accommodating and dispensing portion 32 and transporting unit 29 are driven.

Thus, coins in the accommodating and dispensing portion 32 are fed one by one to the coin passage 38, transported one by one by the belt 46 in the dispensing and transporting direction F2, transported to the front end, which is the terminal end, of the dispensing passage portion 45 and ejected to the dispensing escrow unit 34, ejected to the coin dispensing port 16 through the chute portion 86, which is rotated and arranged to the ejecting position to the coin dispensing port 16 in advance, and collected into the dispensing tray 17.

In the case where coins are dispensed from the plurality of accommodating and dispensing portions 32, coins are dispensed from any one of the accommodating and dispensing portion 32, and then coins are successively dispensed from the other accommodating and dispensing portions 32. Moreover, since the timings of feeding coins in the accommodating and dispensing portions 32 to the coin passage 38 are adjusted and the corresponding plurality of accommodating and dispensing portions 32 can be simultaneously operated, coins fed to the coin passage 38 can be prevented from interfering with the gate member 50 of the other accommodating and dispensing portion 32.

In the case where a sensor for detecting the dispensing tray 17 is filled with coins is preset on the dispensing tray 17 and detects a full state, the collecting operation is temporarily stopped and coins are prevented from overflowing the dispensing tray 17. Additionally, the collecting operation may be restarted by a restarting instruction after taking-out of coins from the dispensing tray 17, or restarted after the sensor detects removal of the full state.

Additionally, in collecting coins, coins of all denominations may be collected once, or coins may be individually collected for each denomination.

Additionally, in individually collecting coins for each denomination, coins may be ejected to the dispensing tray 17 by the packing number unit in which coins are packed with packing paper and defined as a packing coin. In this case, coins are collected by the packing number unit and can be easily put in order. At this time, in the case where the packing number units, each in which coins are packed with packing paper and defined as a packing coin, are different in denomination, coins corresponding to the packing number unit are ejected to the dispensing tray 17 for each denomination.

In the coin depositing and dispensing machine 11 thus constituted, in the case of dispensing coins from the accommodating and dispensing portion 32, the projection 75 retracts under the dispensing and transporting face 70 in accordance with the opening operation of the gate member 50 to the coin inlet/outlet 32*a*, and coins are allowed to be transported to the dispensing and transporting passage 69. Additionally, in the case of dispensing no coin from the accommodating and dispensing portion 32, the projection 75 projects from the dispensing and transporting face 70 in accordance with the closing operation of the gate member 50 to the coin inlet/outlet 32*a*, transportation of coins to the dispensing and transporting passage 69 is regulated, and the coins are returned to the accommodating and dispensing portion 32. Thus, coins, which are accommodated with the coins not aligned, can be reliably dispensed one by one without jamming the accommodating and dispensing portion 32, a simple mechanism enables a predetermined number of coins to be reliably dispensed, and coins can be promptly additionally dispensed by retracting the projection 75 under the dispensing and transporting face 70.

Since the projection 75 is moved in accordance with operation of the gate member 50 serving as an opening/closing member and sorting member, no driving unit dedicated to the projection 75 is required, a driving unit and the gate member 50 is used for the projection 75, and the projection 75 can be reliably operated in accordance with dispensing and accommodating of coins.

In the accommodating and dispensing portion 32, since coins are accommodated, with the coins not aligned, with use of the rotary disc 60 and hopper 61, there does not arise a conventional case where coins are incorrectly accommodated and stood up when being piled up and accommodated in a cylinder. Thus, coins can be reliably accommodated and dispensed. Additionally, basic constitutions of the pooling and feeding portion 31 and accommodating and dispensing portion 32 can be made common to each other.

When dispensing of a predetermined number of coins is detected by the detecting unit 83, the rotary disc 60 is continuously rotated, the coin inlet/outlet 32*a* is closed by the gate member 50, and the projection 75 is projected from the dispensing and transporting face 70 to regulate dispensing of coins. When a coin not recognized as a normal coin by the recognition unit 30 exists, a coin can be promptly additionally dispensed, because the projection 75 is retracted under the dispensing and transporting face 70 in accordance with the opening operation of the gate member 50 to the coin inlet/outlet 32*a*, coins are allowed to be transported to the dispensing and transporting passage 69 and the rotary disc 60 is continuously rotated until completion of dispensing of a predetermined number of normal coins.

Moreover, a reject box for accommodating reject coins, which are not recognized as normal coins by the recognition unit 30 and deviated from the coin passage 38 in a depositing process, may be provided removable from the main body 12 of the coin depositing and dispensing machine 11 into the machine body 12 of the coin depositing and dispensing machine 11. In this case, it is detected whether the reject box is attached to the machine body, reject coins may be transported and accommodated into the reject box when attachment is detected, or transported to the coin dispensing port 16 and returned when no attachment is detected. Thus, even if, for example, a transporting destination of reject coins is set to the reject box, the reject coins are automatically transported to the coin dispensing port 16 and can be returned if no reject box is attached.

The present invention is applied to a coin dispensing device of a coin processing machine such as a coin depositing and dispensing machine or coin dispenser.

The invention claimed is:

1. A coin dispensing device comprising:

an accommodating portion accommodating coins with the coins not aligned;

a dispensing port dispensing coins in the accommodating portion from the accommodating portion;

a dispensing unit dispensing coins one by one from the accommodating portion;

a dispensing and transporting passage having a dispensing and transporting face for guiding coins, which are dispensed one by one from the accommodating portion by the dispensing unit, to the dispensing port;

a detecting unit disposed downstream, in relation to the dispensing port, in a transporting direction and detects coins dispensed from the dispensing port;

an opening/closing member opening/closing the dispensing port; and a projection either vertically projecting from or retracting under the dispensing and transporting face of the dispensing and transporting passage, wherein in dispensing coins, retracts under the dispensing and transporting face in accordance with an opening operation of the opening/closing member to the dispensing port and allows coins to be transported to the dispensing and transporting passage, and wherein in dispensing no coin, projects from the dispensing and transporting face in accordance with a closing operation of the opening/closing member to the dispensing port, regulates transportation of coins to the dispensing and transporting passage and returns the coins to the accommodating portion.

2. The coin dispensing device according to claim 1, comprising a controlling unit which makes the opening/closing member close the dispensing port and the projection project from the dispensing and transporting passage when the detecting unit detects a predetermined number of coins are dispensed.

3. The coin dispensing device according to claim 1, wherein the dispensing unit comprises:

a rotary disc for rotating at a position tilted at a predetermined angle in relation to a horizontal direction;

a hopper which faces and covers a surface side of the rotary disc, has a one side face which is a surface of the rotary disc, pools coins with the coins not aligned, and is opened upward; and a plurality of picking-up members which project from the surface of the rotary disc, and in dispensing coins, by rotation of the rotary disc, locks coins to be dispensed and sends the coins to the dispensing and transporting passage.

* * * * *